US006017188A

United States Patent [19]

Benton

[11] Patent Number: 6,017,188

[45] Date of Patent: Jan. 25, 2000

[54] PATIO TABLE AND POLE FAN COMBINATION

[76] Inventor: Carolyn Benton, P .O. Box 6773, Kansas City, Mo. 64123

[21] Appl. No.: 09/119,145

[22] Filed: Jul. 20, 1998

Related U.S. Application Data

[60] Provisional application No. 60/059,178, Sep. 17, 1997.

[51] Int. Cl.[7] ..... F16M 13/00; A45B 23/00

[52] U.S. Cl. ..... 416/5; 416/142; 416/146 R; 416/170 R; 416/244 R; 362/96; 248/519; 248/523; 248/529

[58] Field of Search ..... 416/5, 142, 146 R, 416/170 R, 246, 244 R, 210 R; 248/519, 523, 529; 417/326, 411, 423.1, 424.1; 362/96

[56] References Cited

U.S. PATENT DOCUMENTS 5,007,811 4/1991 Hopkins ..... 135/16
5,172,711 12/1992 Mueller et al. ..... 135/16
5,273,062 12/1993 Mozdzanowski ..... 135/136
5,711,331 1/1998 Harris ..... 135/16
5,765,582 6/1998 Molnar, IV ..... 135/16

*Primary Examiner*—Edward K. Look
*Assistant Examiner*—Matthew T. Shanley
*Attorney, Agent, or Firm*—Mark Manley

[57] ABSTRACT

A patio table and fan combination. The device uses a fan mounted on a pole that passes through the center of the patio table. The pole also supports an umbrella that can be used for shade when the table is located outside. The fan motor is mounted co-axially with the fan. The device includes pole mounted lights and a mist device. The patio table fan combination is powered by conventional household electrical outlet or by solar panels mounted on the patio umbrella. The central pole for the device comes in three pieces to facilitate shipping and assembly.

7 Claims, 3 Drawing Sheets

PATIO TABLE AND POLE FAN COMBINATION

This application claims benefit of Provisional Application 60/059,178 filed Sep. 17, 1997.

BACKGROUND OF THE INVENTION (1) Field of the Invention

The present invention relates to a patio table and fan combination.

(2) Description of the Prior Art

U.S. Pat. No. 5,007,811 to Hopkins is the closest prior art known. This device was primarily designed as a retrofit device. That is to say that the light and fan were designed to fit on a patio table with an umbrella that were already set up and in use. The advantage of the Hopkins '811 device is that you can put the fan on without taking the umbrella off. This design has several problems including the concern that the retrofit design would not have a stable enough pole to support the rotating fan. The design is also undesirable and unnecessary for a new fan and table combination. Specifically Hopkins calls for a one piece pole which would be undesirable because it would increase the product shipping costs. The light of Hopkins was intended only for advertising, and would not provide illumination for people seated at the table.

As will be seen from the subsequent description of the embodiments of the present invention, the shortcomings of the prior art are overcome.

SUMMARY OF THE INVENTION

Decks and screened porches have become very popular. People like to have furniture that is specially made for this type of use. It is common to have a patio table and a set of chairs specifically for use on the deck. Often times the patio table will have an umbrella that can be raised and lowered, typically the umbrella is located on a shaft that comes through the center of the table. The present invention adds several things to the patio furniture currently available. A fan and lights are added in an effort to increase the amount of time that a person can use the patio. Specifically the device will provide a cool breeze that will also drive off insects. The lights will allow the user to enjoy the patio later into the evening, this will have particular appeal with restaurants and bars.

The present invention relates to a patio table and fan combination. The device provides for a fan to create additional air movement for a patio table used outdoors or in a closed in porch area. The fan is mounted on a pole and is co-axial with the pole. The fan is electric powered and has multiple blades.

The pole which has a solid base set on the ground passes through a hole in the center of the patio table and has a set of lights mounted on it for use by people seated at the patio table. The pole comes in several sections that slip together to aid in assembly and to reduce shipping costs.

In one embodiment the device has an overhead umbrella mounted on the top of the pole above the fan. This is for use outside where shade would be needed. The umbrella carries solar panels that can power the fan and lights. The outdoor version includes a water mist system that will allow for a cool mist when in use.

An embodiment designed for use on a sun porch, where there is a roof, does not have the umbrella and plugs into an outlet in the house for power.

DESCRIPTION OF THE PREFERRED EMBODIMENTS

Figure 1:
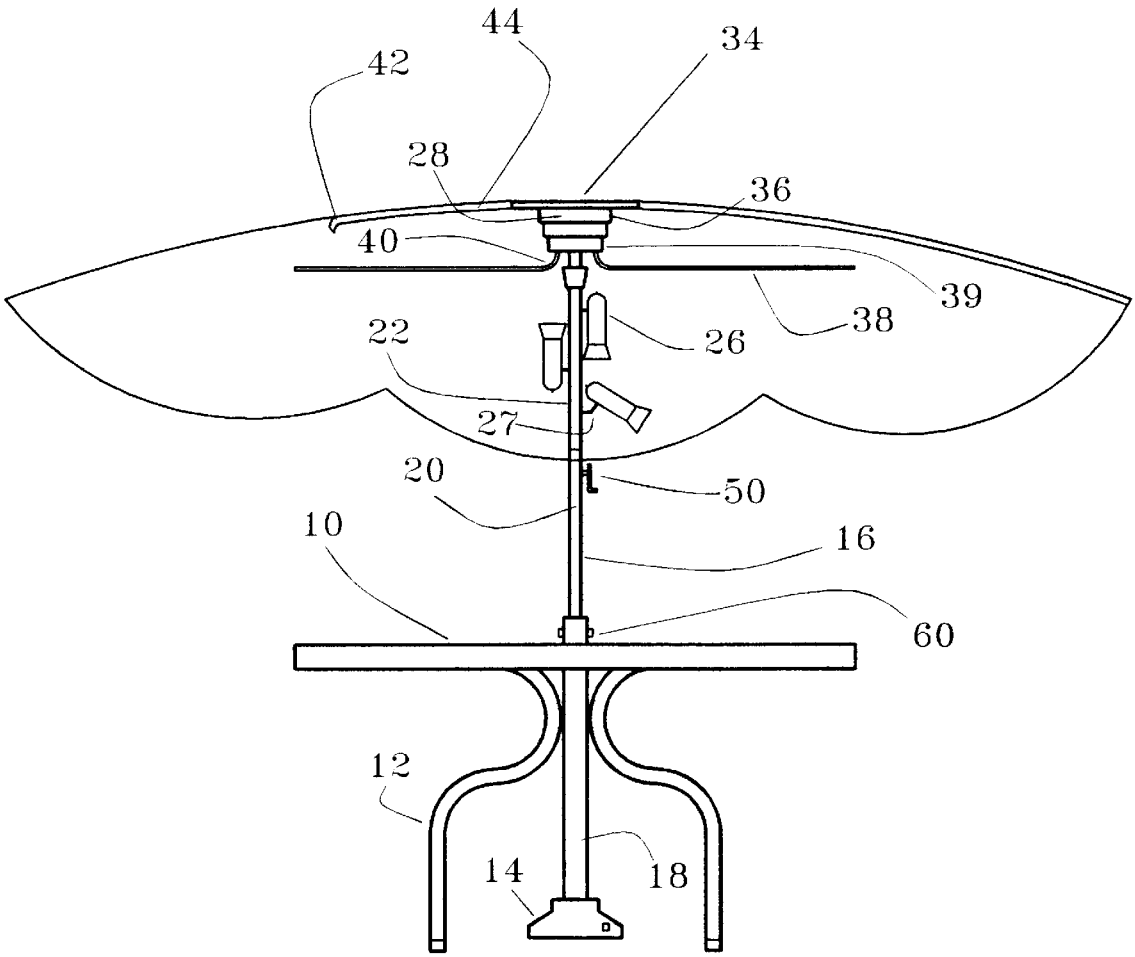
FIG. 1 shows a drawing of the patio table/fan combination

Referring to FIG. 1, a patio table/fan combination is shown. The patio table is of conventional design having legs (12). A stable base (14) supports an upright pole (18). The lower end of the pole (18) fits into the base (14) while the upper end of the pole (18) passes through the table top. A second section of pole (20) fits coaxially with pole (18) and extends vertically to support a third section of pole (22). The table top has a usable surface with a clearance hole for pole (18).

The third section of pole (22) supports adjustable lights (26). These lights can be turned on and off individually and are supported by conventional flexible supports (27).

The device includes a fan (28). The fan motor (36) is sealed for outdoor use and includes a conventional coaxial output (39) to which the fan blades are mounted. The fan includes a solar panel (34) that can power the DC fan motor (36). The fan includes blades (38) that are hinge mounted to the fan motor (36) by hinges (40). The patio table combination includes a misting attachment (42) that provides a mist of water from a pressurized source of water (not shown) through supply tube (44). The fan motor (36) is mounted coaxially with the pole (22), this arrangement is advantagous in terms of appearance and stability of the unit.

The patio table combination includes a handle (50) that allows the umbrella to be taken down in a conventional manner.

Figure 2:
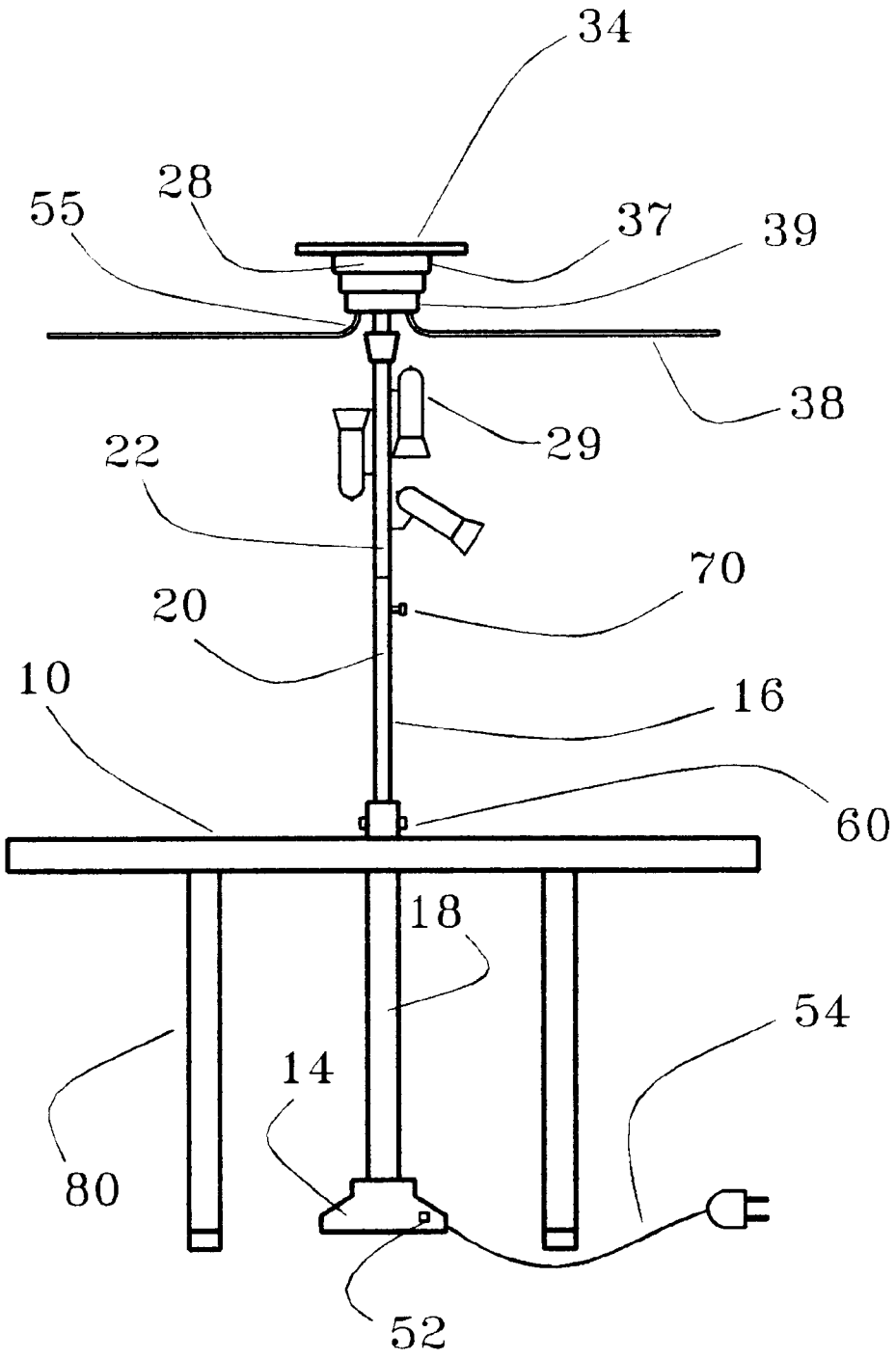
FIG. 2 shows a second embodiment of the patio table/fan for use indoors

Referring to FIG. 2 an alternative embodiment of the patio table device is shown. This embodiment is for use in a covered area such as a screened in porch. In these areas the umbrella is not needed and the sun is not available to power the unit. This embodiment uses a ridged fan blade mounting (29). This unit also includes a power circuit from the house current. The base (14) includes a plug in receptacle (52) and a power cord (54). Since it would be used in a covered area this embodiment would use an AC powered motor (37) and lights (29) instead of the DC used by the embodiment of FIG. 1. The height of the unit can be adjusted by a spring loaded pawl (60) which fits into holes spaced axially along the pole (20). The switch (70) can be used to switch the unit from DC solar power to conventional household AC current as will be seen in the description of FIG. 3.

One of the major advantages of the unit is its ease of assembly. The three section pole allows the unit to be shipped inexpensively and allows for about anyone to assemble the unit very quickly.

In operation the user can plug in the cord (54) and sit at the table. The operation of the fan (38) will create an updraft or down draft of cool air that will tend to drive off any insects. The lights (26) may be turned on for evening use and the height of the pole may be adjusted using pawl (60). The power cord (54) runs coaxially through the segmented poles to reach the lights and the fan motor.

Figure 3:
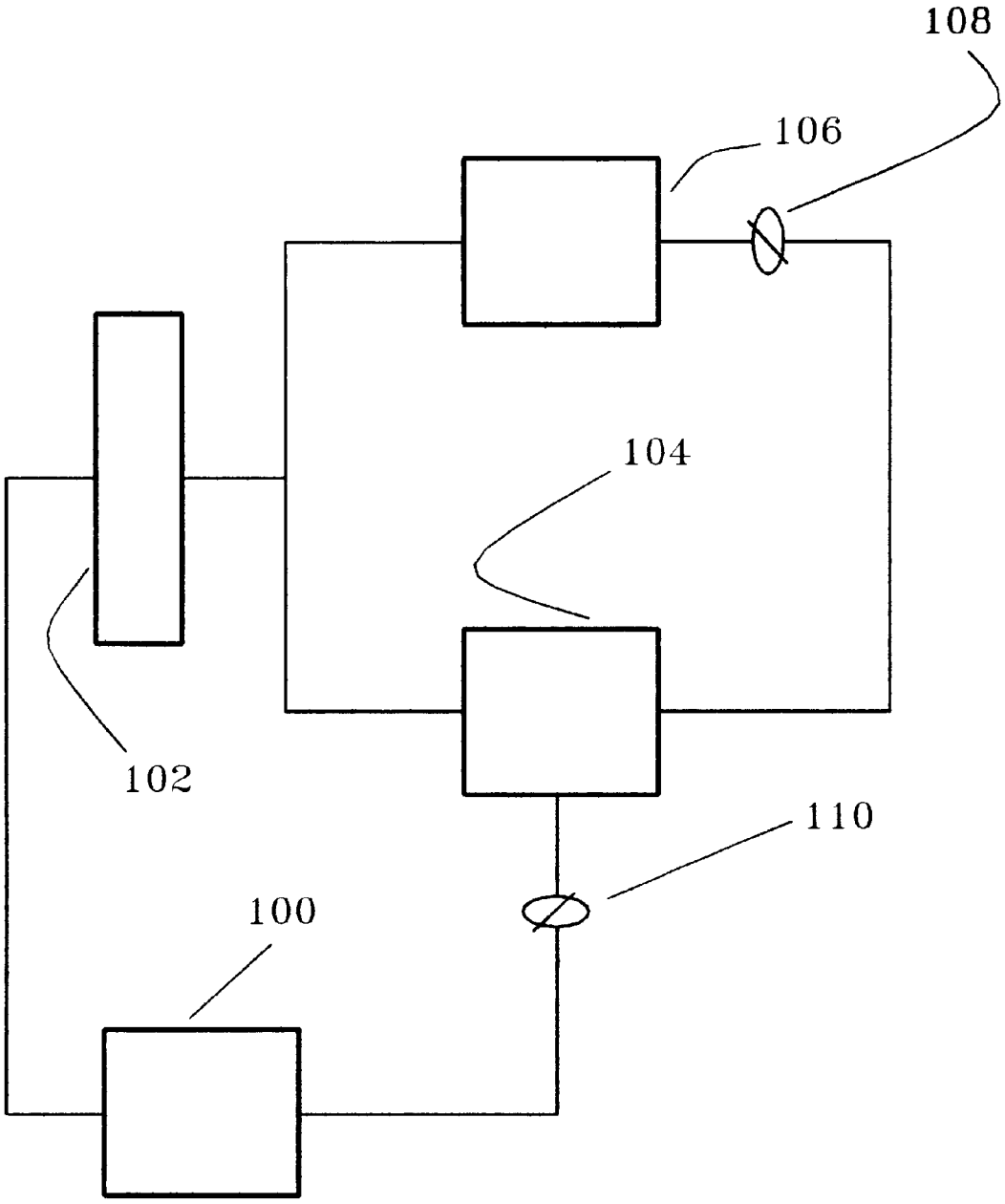
FIG. 3 shows an electrical schematic for the motor

FIG. 3 shows the power circuit for the embodiment of FIG. 1. In this case the user could use AC or DC power to power the fan motor (36). A conventional AC to DC converter (100) provides DC power to the load (104) which includes the lights (29) and fan motor (36) a DC battery pack (102) provides back up power. A switch (70), not shown in this figure, controls contacts (108) and (110) and when thrown will disconnect the AC power side by opening contact (110) and will connect the solar power panel (106) by closing contact (108). Typically, the embodiment of FIGS. 1 and 3 would run off the solar power side, at night or on cloudy days it could be switched to run off household current. The embodiment off FIG. 2 would run off AC current only and would have an AC motor and lights since there would be no reason to convert to DC.

What is claimed is:

1. A pole fan for use on a deck comprising:

a table;

a pole having an upper end and a lower end;

a DC powered motor mounted on the upper end of said pole, said motor being coaxial with said pole;

said motor having an output shaft supporting a plurality of fan blades;

an umbrella mounted adjacent to said motor;

DC powered lights adjustably mounted on said pole.

2. A pole fan for use on a deck comprising:

a table;

a sectional pole having a plurality of sections, a first of said pole sections having a first end fitting into a base and a second end;

a second of said pole sections having a first end engaged with said second end of said first section and having a second end;

a motor with an output shaft;

said motor being mounted on said second pole section;

an umbrella mounted on top of said motor;

electrical power cord running through said sectional pole to said motor;

said sectional pole having height adjustment means.

3. A pole fan for use on a deck comprising:

a table;

a sectional pole having a plurality of sections, a first of said sections having a first end fitted into a base and a second end;

a second of said pole sections in coaxial engagement with said second end of said first section;

said second of said pole sections having a first end engaged with said first pole section and having a second end;

a motor;

said motor having fan blades mounted thereto;

said motor being mounted on said second end of said second pole section with said motor being coaxial with said second pole section;

said second pole section has at least one mounting bracket with a light mounted thereon.

4. A patio table in accordance with claim 3 wherein:

an umbrella is mounted adjacent to the motor.

5. A patio table in accordance with claim 4 wherein:

an AC power cord provides power to said motor and to said light and wherein said cord runs through the base and said segmented pole.

6. A pole fan for use on a deck comprising:

a table;

a sectional pole having a plurality of sections, a first of said pole sections having a first end fitted into a base and a second end;

a second of said pole sections in co-axial engagement with said second end of said first section;

said second of said pole sections having a first end engaged with said first pole section and having a second end;

a motor;

fan blades mounted to said motor;

said motor being mounted coaxially on the second end of said second pole section;

said second section having at least one light mounted thereon.

7. A pole fan according to claim 6 wherein:

An AC power cord provides power to said motor and to said lights and wherein said cord runs through the base and said sectional pole.

* * * * *